US006396460B2

(12) United States Patent
Tseng et al.

(10) Patent No.: US 6,396,460 B2
(45) Date of Patent: May 28, 2002

(54) CHIP ANTENNA

(75) Inventors: Wen-Jen Tseng, Kaohsiung; Jyh-Wen Sheen, Hsinchu; Jian-Hong Chen, Taipei County, all of (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 09/851,310

(22) Filed: May 9, 2001

(30) Foreign Application Priority Data

May 11, 2000 (TW) ..... 89108988
Oct. 30, 2000 (TW) ..... 89218788 U

(51) Int. Cl.[7] ..... H01Q 1/36
(52) U.S. Cl. ..... 343/895; 343/760 MS
(58) Field of Search ..... 343/895, 700 MS, 343/702, 873

(56) References Cited

U.S. PATENT DOCUMENTS 5,870,065 A * 2/1999 Kanba et al. ..... 343/895
6,028,554 A * 2/2000 Mandai et al. ..... 343/700 MS
6,281,848 B1 * 8/2001 Nagumo et al. ..... 343/700 MS

* cited by examiner

*Primary Examiner*—Don Wong
*Assistant Examiner*—James Clinger
(74) *Attorney, Agent, or Firm*—Intellectual Property Solutions, P.L.L.C.

(57) ABSTRACT

The present invention relates to a chip antenna which comprises a substrate, a feeding pad, a feeding conductor, a matching unit, and a meandering conductor. The substrate formed with a dielectric material. By varying the length of the meandering conductor, the central frequency of the chip antenna can be properly obtained and controlled. The matching unit, which is formed by joining a matching conductor with a ground plate, uses the short-circuit function of the matching conductor to obtain the desired bandwidth. In this way, the chip antenna is well suited for applications in wireless communication systems, including personal mobile communication networks and equipment.

23 Claims, 18 Drawing Sheets

CHIP ANTENNA

BACKGROUND OF THE INVENTION

1. Field of the Invention

The present invention generally relates to chip antennas, and more particularly, to a broadband chip antenna for use in wireless communication networks and equipment, including short-distance wireless communication and personal mobile communication networks and equipment.

2. Description of the Related Art

When developing and designing wireless mobile communication devices, due to the constraint on size, monopole antennas 10 with a quarter wavelength, as shown in FIG. 1, are generally incorporated in device as basic units. However, the developing direction is moving slowly toward devices that are lighter, thinner, shorter, and smaller.

The concept of using a special winding shape to shorten the length of a wire antenna is first developed in 1984. For instance, a winding antenna of a zigzagging or meandering shape is disclosed by H. Nakano, H. Tagami, A. Yoshizawa, and J. Yamauchi in an article entitled "Shortening Ratios of Modified Dipole Antenna", which is published in *IEEE Trans. Antennas Propagat.*, AP-32, pp. 385–386. In 1996, a winding antenna of a bow-tie shape, which further shortens the antenna length, is disclosed in "IEEE AP-S International Symposium", pp. 1566–1569 by M. Ali and S. S. Stuchly.

FIG. 2 shows a conventional chip antenna 20 of a meandering type (European patent 0 764 999 A1). The chip antenna 20 has a substrate 22 of a dielectric and/or magnetic material. A metal conductor 24 is disposed in or on the outer surface of the substrate as a meandering line, or a zigzagging line (not shown). One end of the metal conductor 24 is used as a feeding point 26, which is connected to the feeding pad 28. By utilizing the intrinsic characteristic, length, and number of turns or curves of the metal conductor, the general design principle regarding self-matching functions can be achieved so that the antenna can have proper resonance and radiation. However, one drawback of this type of chip antenna is that it has limited range on reduction of size.

As shown in FIG. 3, another type of conventional chip antenna 30 (U.S. Pat. No. 5,764,198) uses a spirally wounding conductor 32 and a capacitor 34 connected in parallel to achieve the matching function for the antenna. Although the chip antenna of this type is of a reduced size, its bandwidth is limited.

SUMMARY OF THE INVENTION

Due to the difficulty in bandwidth expansion for the above-discussed chip antenna, it is a primary object of the present invention to provide a chip antenna having a substrate, feeding pad, feeding conductor, matching unit, and meandering conductor to effectively expand bandwidth and reduce size.

The above and other objects, which will become apparent in reading the specification below, are realized by a chip antenna that has a substrate of a dielectric material and one or more layers, and a feeding pad formed on an outer surface of the substrate for signal injection. In particular, a meandering conductor is disposed on at least one layer of the substrate for use as a radiator unit. A conductor is disposed on a substrate layer for use as a feeding conductor for the antenna, and for propagating signals when connected to a signal source. A matching unit disposed on the layers of substrate includes a matching conductor and a ground in which the matching conductor is shielded by at least one plate of the ground. In particular, portions of the matching conductor are respectively connected to the meandering conductor, ground, and feeding conductor.

Other objects and the features will be apparent from the following detailed description of the invention with reference to the appended drawings.

BRIEF DESCRIPTION OF THE DRAWINGS

The present invention will be more fully described and better understood from the following description, taken with the appended drawings, in which.

DETAILED DESCRIPTION OF THE INVENTION

Figure 1:
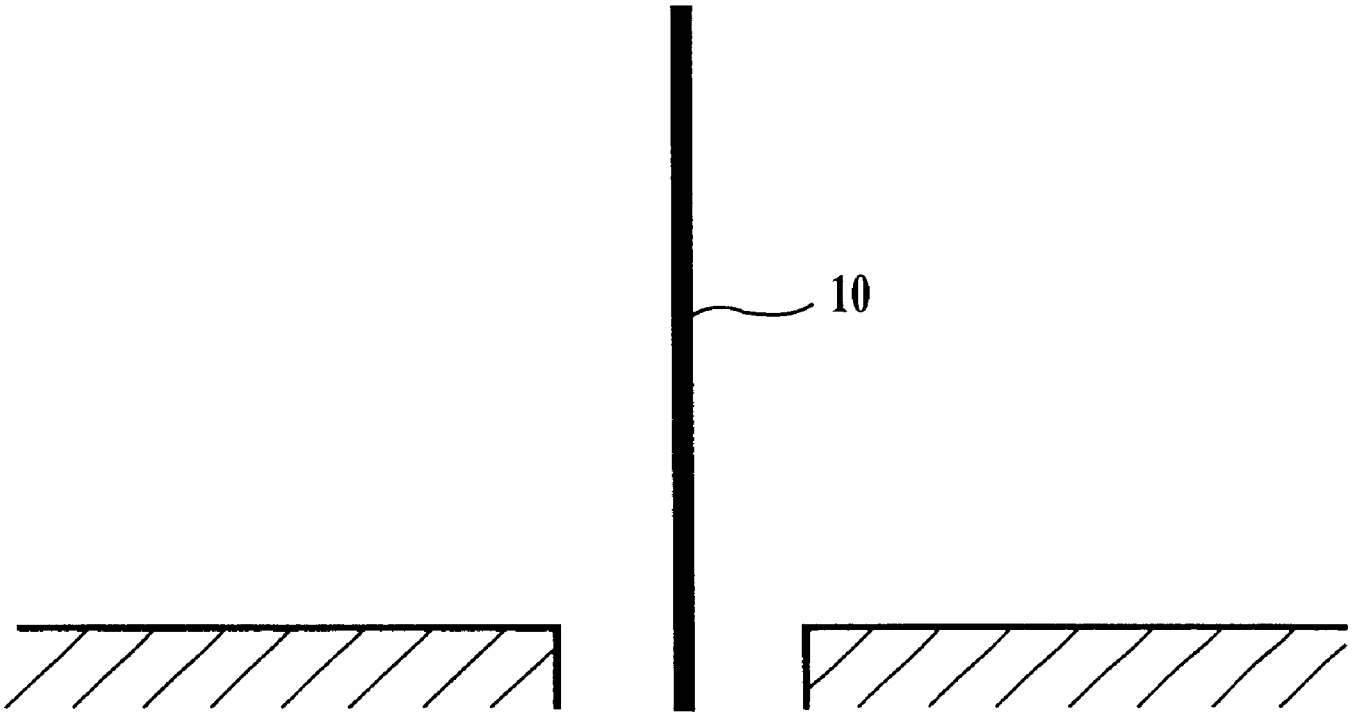
FIG.1 PRIOR ART
FIG. 1 shows a conventional monopole antenna having a quarter wavelength.
Figure 2:
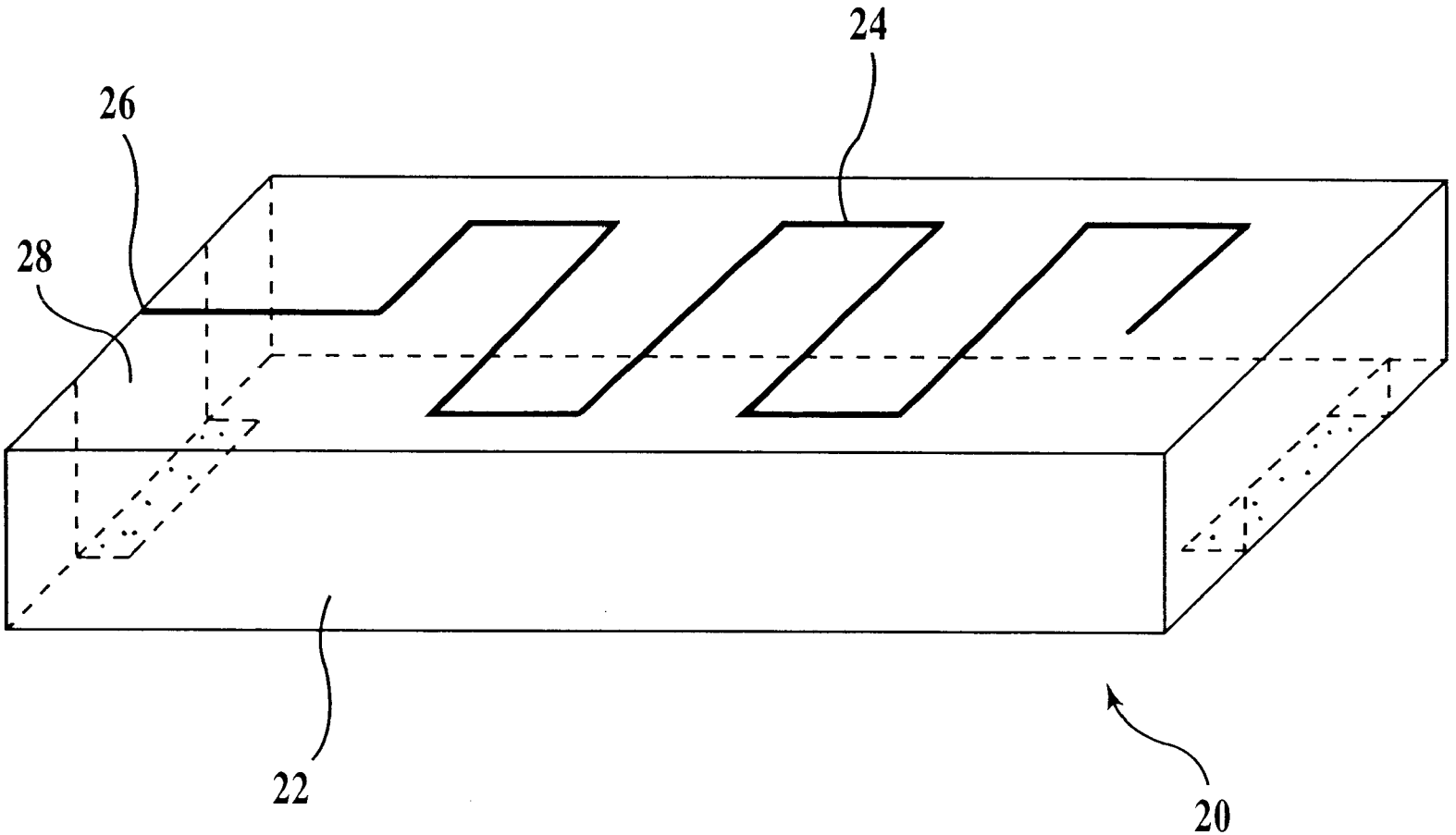
FIG. 2 PRIOR ART
FIG. 2 is a perspective view of a conventional chip antenna.
Figure 3:
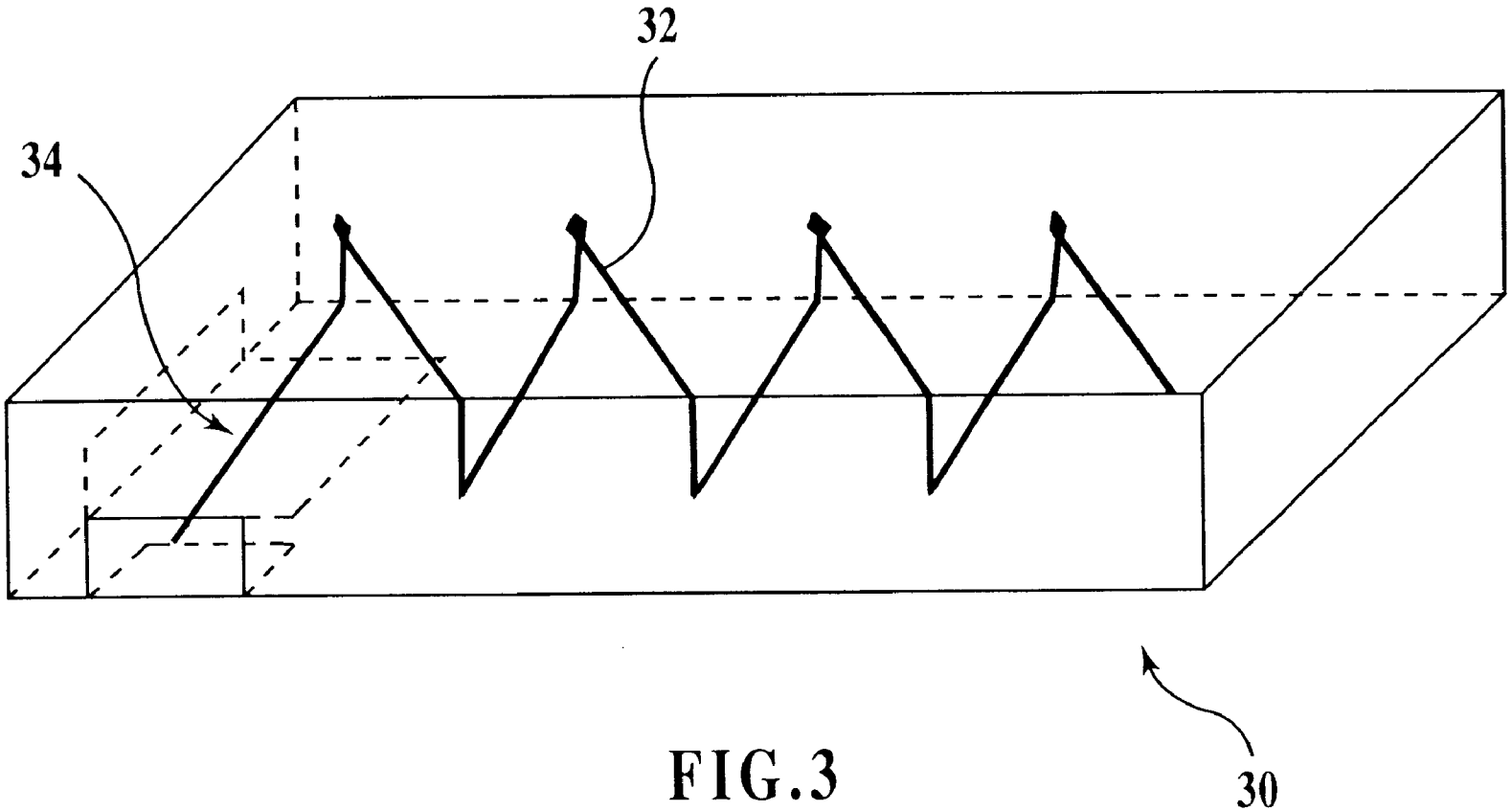
FIG. 3 PRIOR ART
FIG. 3 is a perspective view of another conventional chip antenna.
Figure 4:
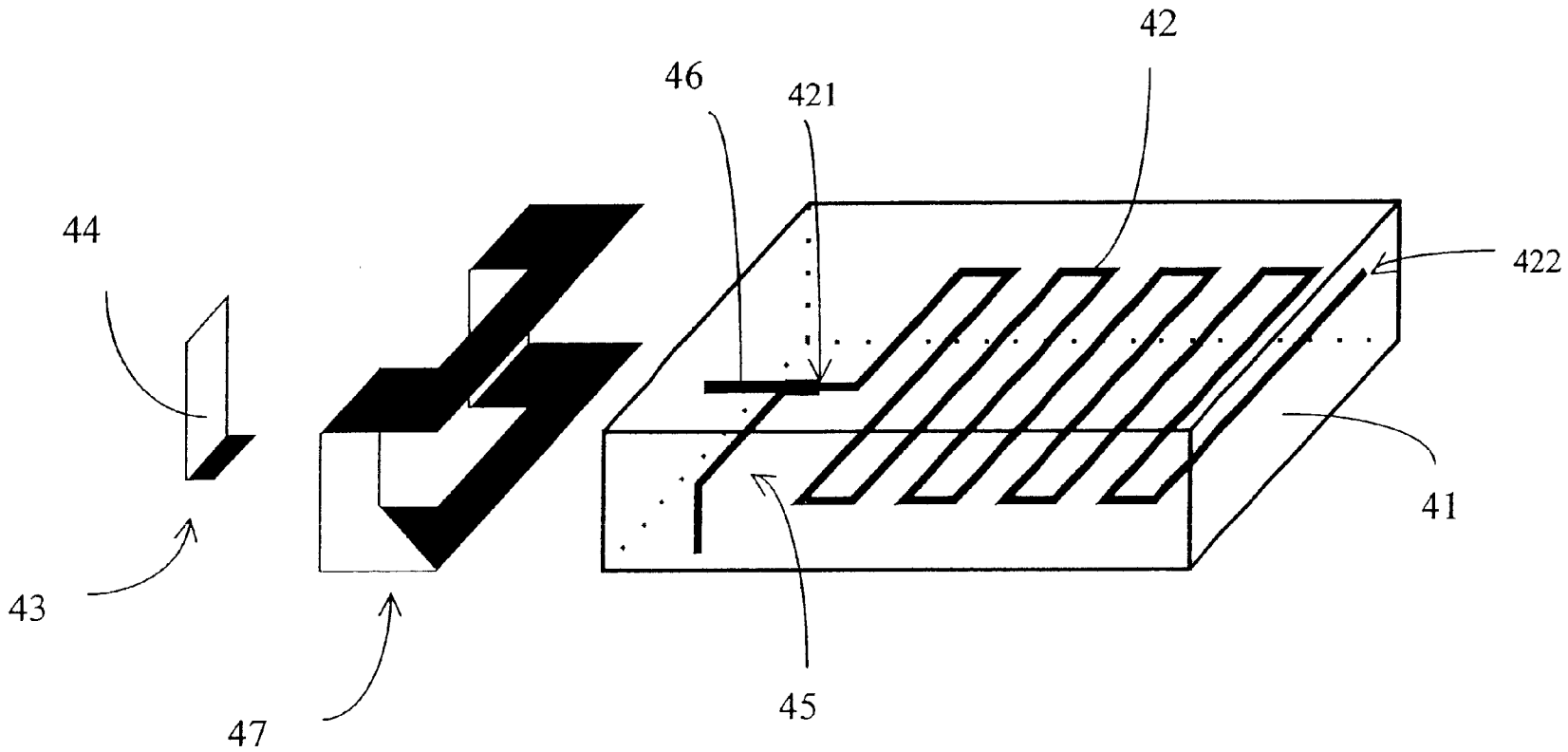
FIG. 4 shows a chip antenna according to a first embodiment of the present invention.

FIG. 4 is a partially exploded view of a first embodiment in accordance with the present invention. A substrate 41 formed from a dielectric material is consisted of, e.g., ceramics, glass/epoxy, or the like. A meandering metal conductor 42 made from, e.g., gold, silver, silver-palladium, copper or alloys, is meanderingly disposed in the substrate 41. A first end 421 of the meandering conductor 42 is linked to a first portion of the matching conductor 45. A second end 422 of the meandering conductor 42 extends longitudinally and meanderingly toward a welding plate 44. As a result, the overall length of the chip antenna is shortened while the effective resonance length and characteristics are nearly that of a monopole antenna of a quarter wavelength. In addition, one end of the feeding conductor 46 is linked to the feeding pad 43, and the other end of the feeding conductor 46 is linked to a second portion and the first portion of the matching conductor 45.

Thus, by controlling the length of the meandering conductor 42, the central frequency of the antenna is affected accordingly. Moreover, the meandering conductor 42 can be wholly or partially placed at the outer surface of the substrate 41, or the interior thereof (not shown). In order to adjust the dimensions of the antenna, the meandering conductor 42 is meandering or zigzagging in shape, and wounding longitudinally or spirally in three dimensions.

When the number of wounding of the meandering conductor 42 increases, the radiation resistance of the antenna decreases and the inductance increases that reduce the overall radiation efficiency and bandwidth of the antenna. Thus, a matching metal conductor is used in the present invention to increase the radiation efficiency and bandwidth. The first embodiment of the present invention is configured to form a strip line structure in which a ground 47 having opposing metal plates shields the matching conductor 45. Moreover, the ground 47 is linked to the second portion of the matching conductor 45 as to propagate a short-circuit condition. It is also permissible to design or implement a specific length and/or width for the matching conductor as to match the input impedance and acquire the desired bandwidth.

Figure 5:
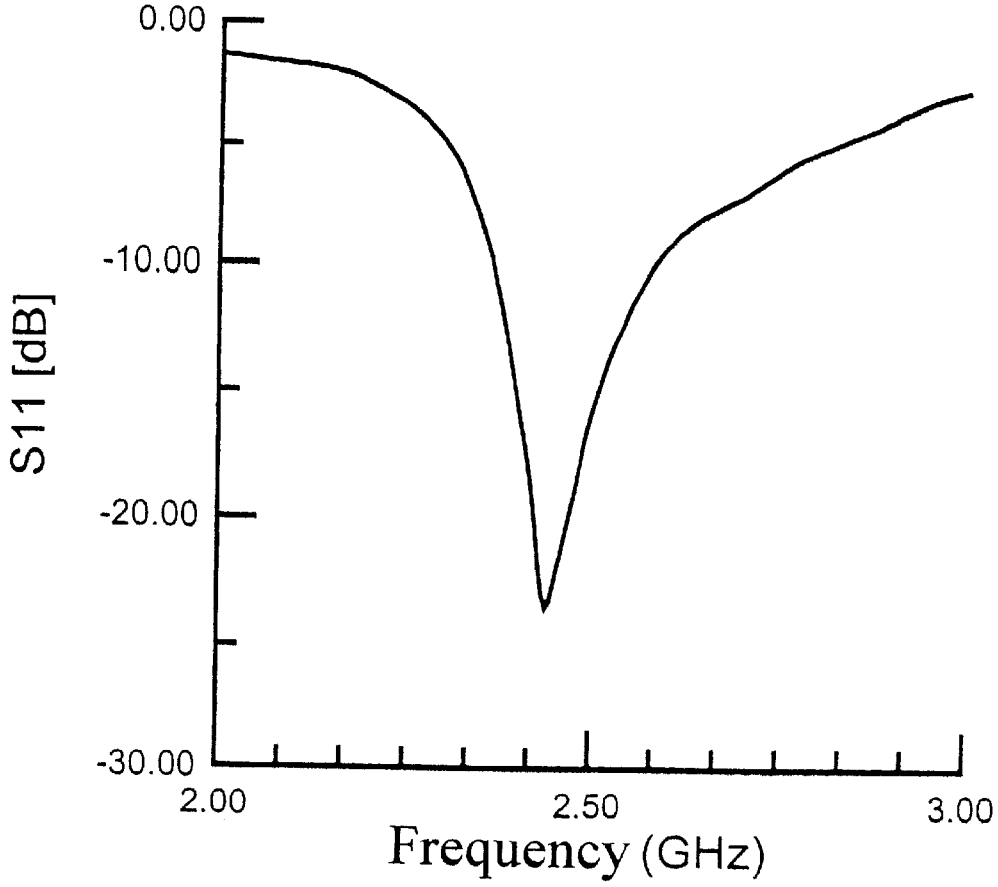
FIG. 5 is a graph illustrating the characteristic of the chip antenna according to the present invention.

FIG. 5 shows the measured result of the antenna's return loss of the present invention. In particular, the central frequency thereof is set at 2.44 GHz, and the bandwidth (−10 dB) can reach upwards of 220 MHz (about 9.2%).

Figure 6:
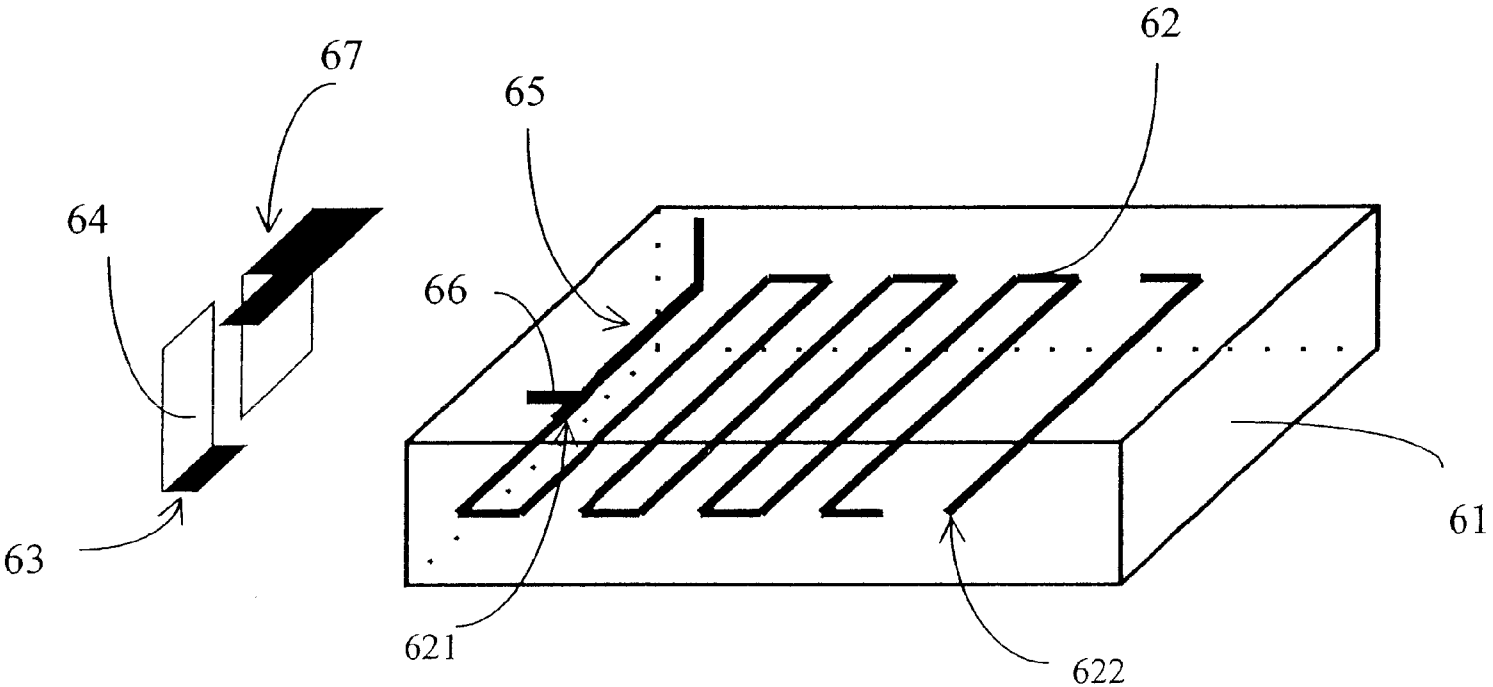
FIG. 6 shows a chip antenna according to a second embodiment of the present invention.

One way to further reduce the size of the chip antenna is shown in FIG. 6, which is directed to a second embodiment of the present invention that adopts a microstrip line structure. The chip antenna in this embodiment is comprised of a substrate 61, a meandering conductor 62, a feeding pad 63, a feeding conductor 66, and a matching unit.

The meandering conductor 62 is disposed in the substrate 61. One end 621 of the meandering conductor 62 is linked to a first portion of the matching conductor 65. The other end 622 of the meandering conductor 62 extends longitudinally and meanderingly toward the opposite direction of a welding plate 64. One end of the feeding conductor 66 is linked to the feeding pad 63. The other end of the feeding conductor 66 is linked to a first and second portion of the matching conductor 65. The matching unit of the present embodiment is comprised of a ground 67 and matching conductor 65 which is shielded by the metal plate of the ground 67. In particular, the ground 67 is linked to the second portion of the matching conductor 65 as to propagate a short-circuited condition. As discussed before, it is permissible to design or implement a specific length and/or width for the matching conductor as to match the input impedance and acquire the desired bandwidth. Moreover, since the physical area in the substrate occupied by the ground 67 is reduced, more space can be allotted to the meandering conductor for use thereof.

Figure 7A:
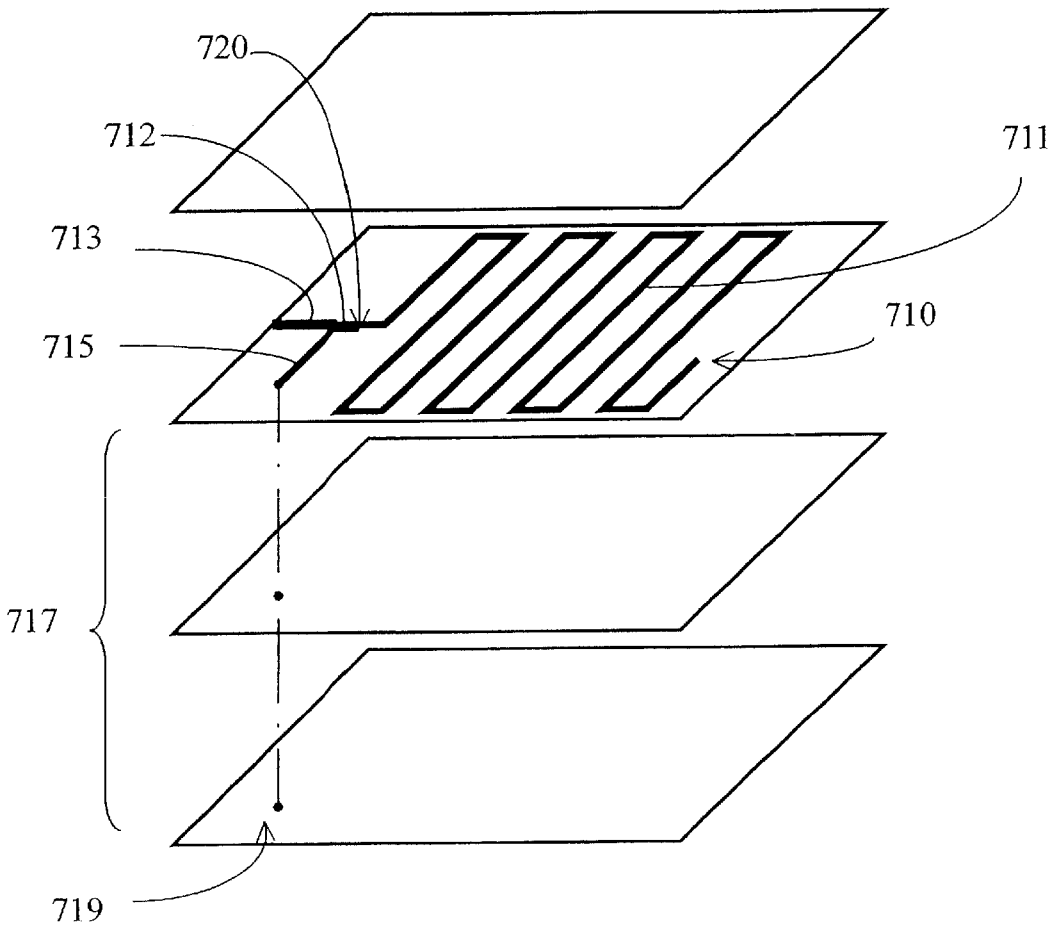
FIG. 7A is an exploded view showing one arrangement for a meandering conductor, feeding conductor, and matching conductor of the present invention.

One way to increase the central frequency of the antenna is to shorten the length of a meandering portion 710 of a meandering conductor 711 as shown in FIG. 7A. In FIG. 7A, the meandering portion 710 of the meandering conductor 711 is disposed on a planar surface of one of the substrate layers. In particular, a feeding conductor 713, the matching conductor portions 715, 712 and the meandering conductors 711 are all disposed on the same substrate layer. A matching conductor portion 717, which passes through a plurality of substrate layers, is connected to the ground (not shown) at a surface point 719. Different sizes and widths of the feeding conductor, matching conductor and meandering conductor can be used.

Figure 7B:
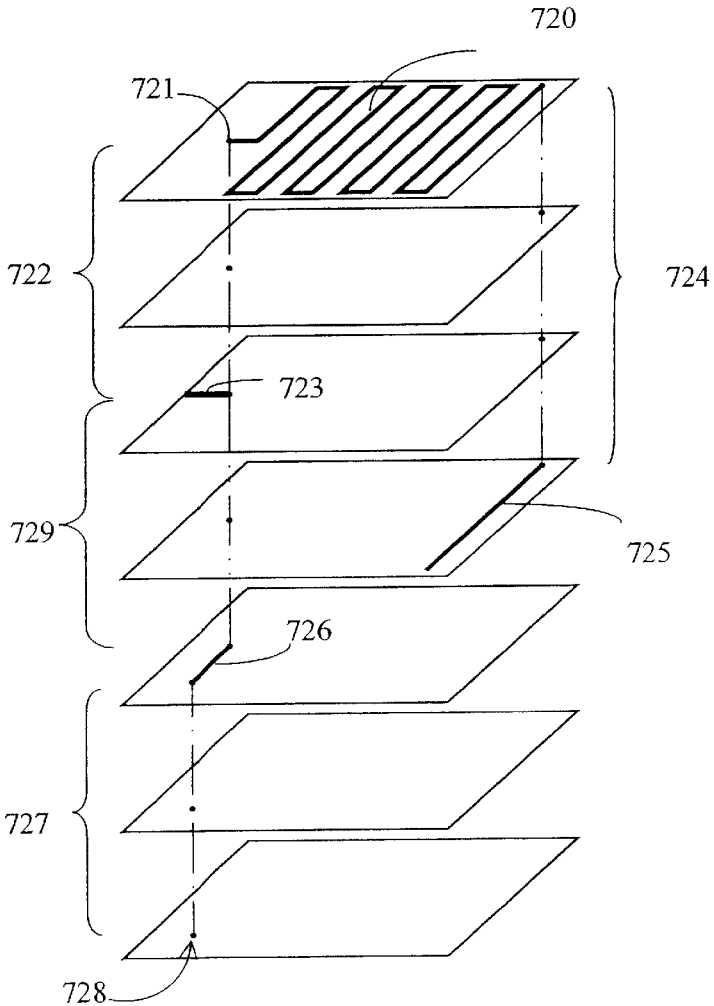
FIG. 7B is an exploded view showing another arrangement for the meandering conductor, feeding conductor and matching conductor of the present invention.

Referring to FIG. 7B, different components or portions relating to the meandering conductor and matching conductor can be spread out over different substrate layers in order to reduce the central frequency of the antenna. More specifically, the main portion 720 of the meandering conductor is disposed on a top layer of the substrate; one end 721 of the meandering conductor is connected to the first portion 722 of a matching conductor, and an end portion 725 of the meandering conductor disposed on a different substrate layer from that of the main portion 720 or feeding portion 723 is disposed on through a linking portion 724 (e.g., extended end portion of the meandering conductor), which also passes through multiple substrate layers. The first portion 722 passes through a plurality of substrate layers and connects to a feeding conduction 723 a portion 729 of a second matching conductor. The portion 729 of a second matching conductor which passes through multiple substrate layers and connects with another portion 726 of the second matching conductor, which is disposed on a substrate layer that is different from the substrate layers of the feeding portion and main portion. The portion 726 is then connected to the ground (not shown) at a surface point 728 through a portion 727.

The meandering conductor of the instant invention controls the central frequency of the antenna and decreases the overall size of the antenna, and the matching unit of the instant invention matches the input impedance of the antenna at the feeding point. Thus, the bandwidth is increased and size is effectively reduced.

Figure 8:
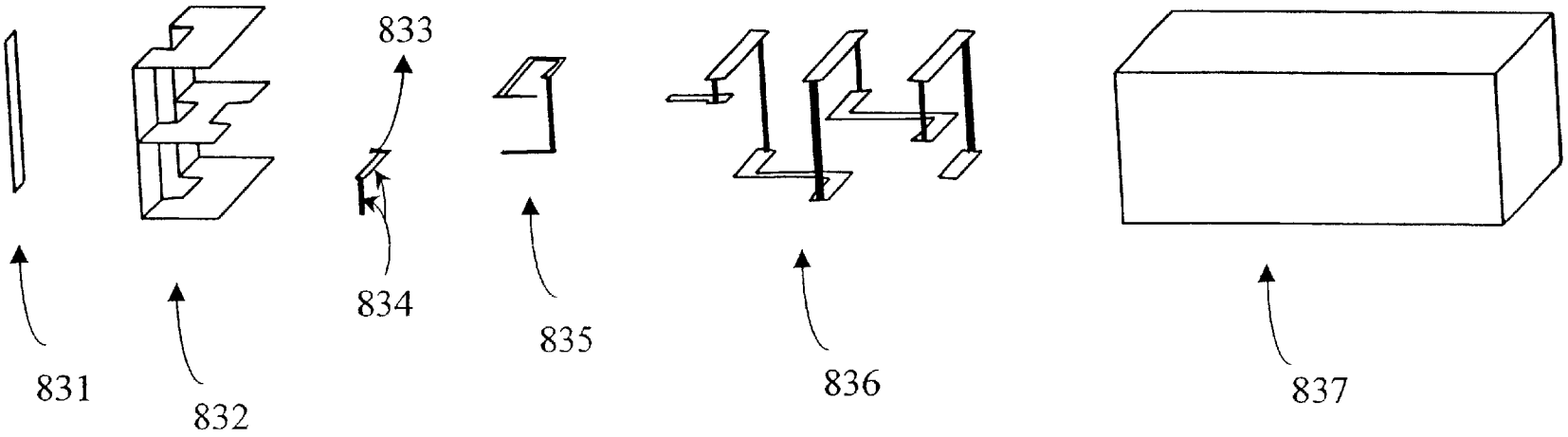
FIG. 8 is an exploded perspective view showing a chip antenna according to a third embodiment of the present invention.

FIGS. 8–16 illustrate a chip antenna according to a third embodiment of the present invention. In FIG. 8 a ground 832, which is divided into sections by three plates, is disposed in a substrate 837 formed from a dielectric material is consisted of, e.g., ceramics, glass/epoxy, or the like. A feeding pad 831 is disposed on the surface of the substrate 837 and connected to a feeding conductor 833. A first matching conductor portion 835, which is bent and passes through multiple substrate layers, is coupled to a meandering conductor 836, while a second matching conductor portion 834 is coupled to one of the three plates.

Figure 9:
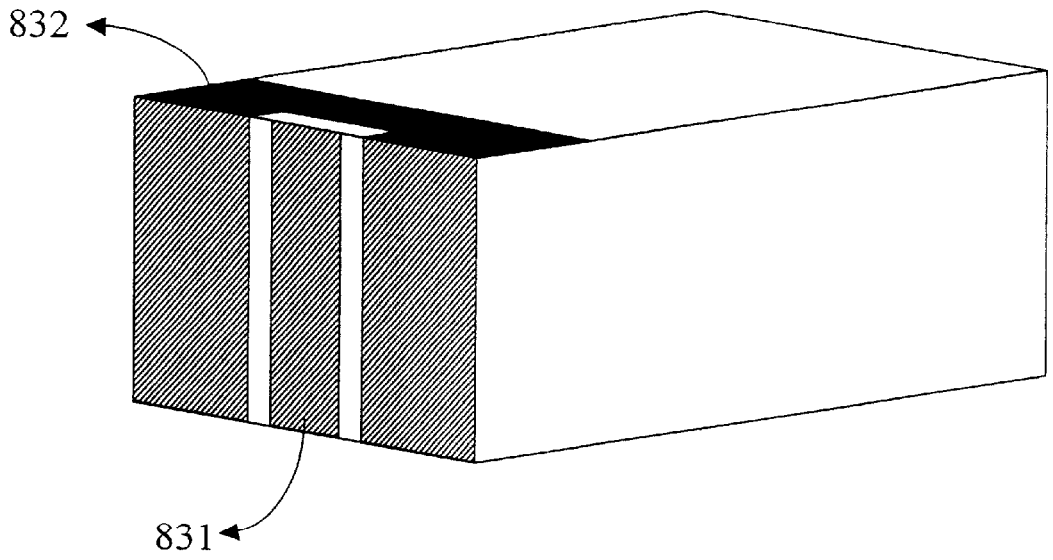
FIG. 9 is an exterior perspective view showing the chip antenna of FIG. 8.

The manner in which the feeding pad 831 and ground 832 are disposed on the exterior surface of the substrate is shown in FIG. 9.

Figure 10:
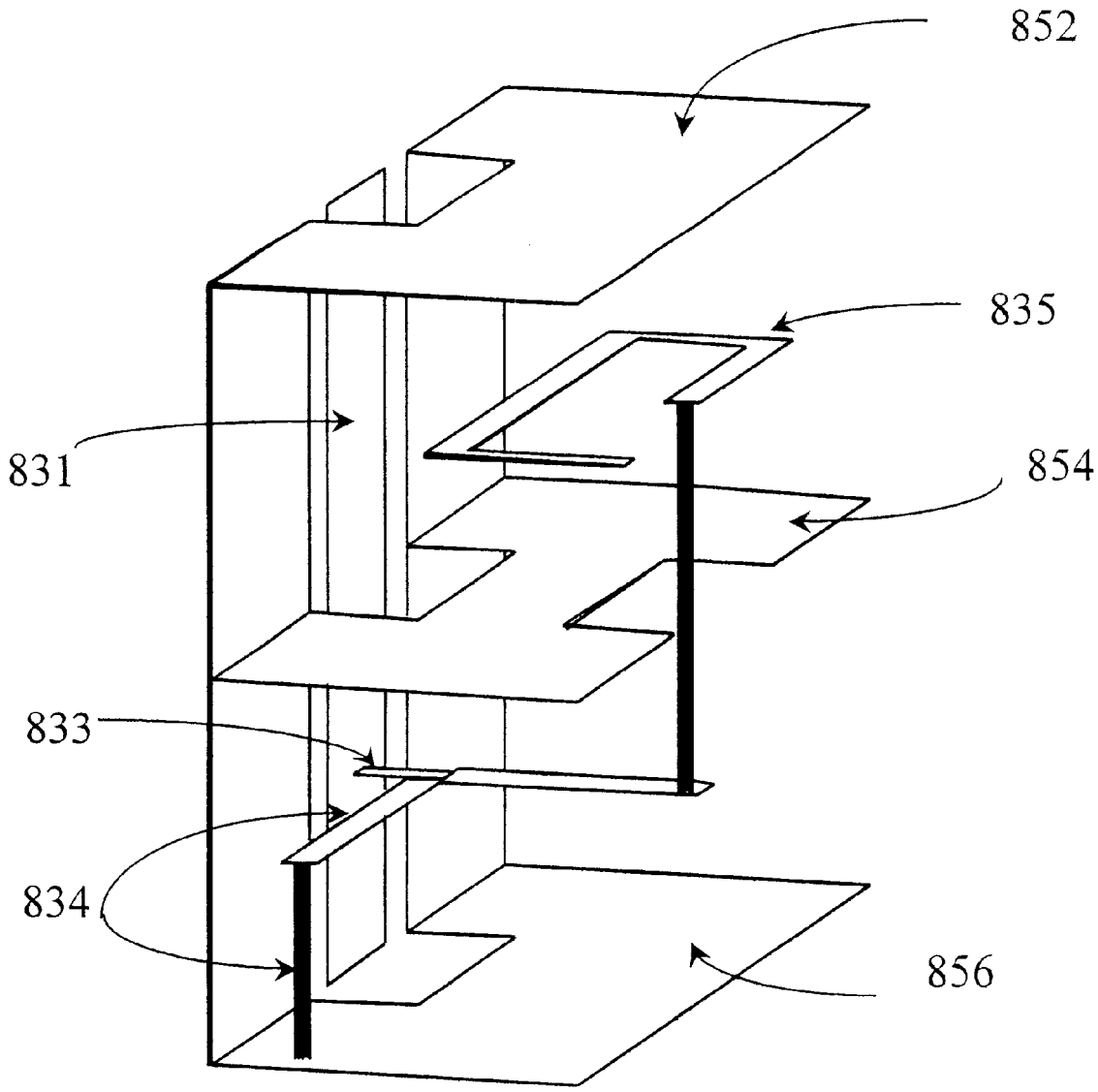
FIG. 10 is an isolated perspective view showing one embodiment for a ground, feeding pad, feeding conductor, and matching conductor of the present invention.

In FIG. 10, the three plates of the ground include a top plate 852, middle plate 854, and bottom plate 856. The second matching conductor portion 834 is connected to the bottom plate 856 and disposed underneath the middle plate 854, while the second matching conductor portion is mainly disposed between the top plate 852 and middle plate 854. As such, a strip line structure is formed for both the first and second conductor portions 835 and 834 due to the fact that the second conductor portion 834 is sandwiched between the bottom plate 856 and the middle plate 854, and the main portion of first conductor portion 835 is sandwiched between the top plate 852 and the middle plate 854.

Figure 11A:
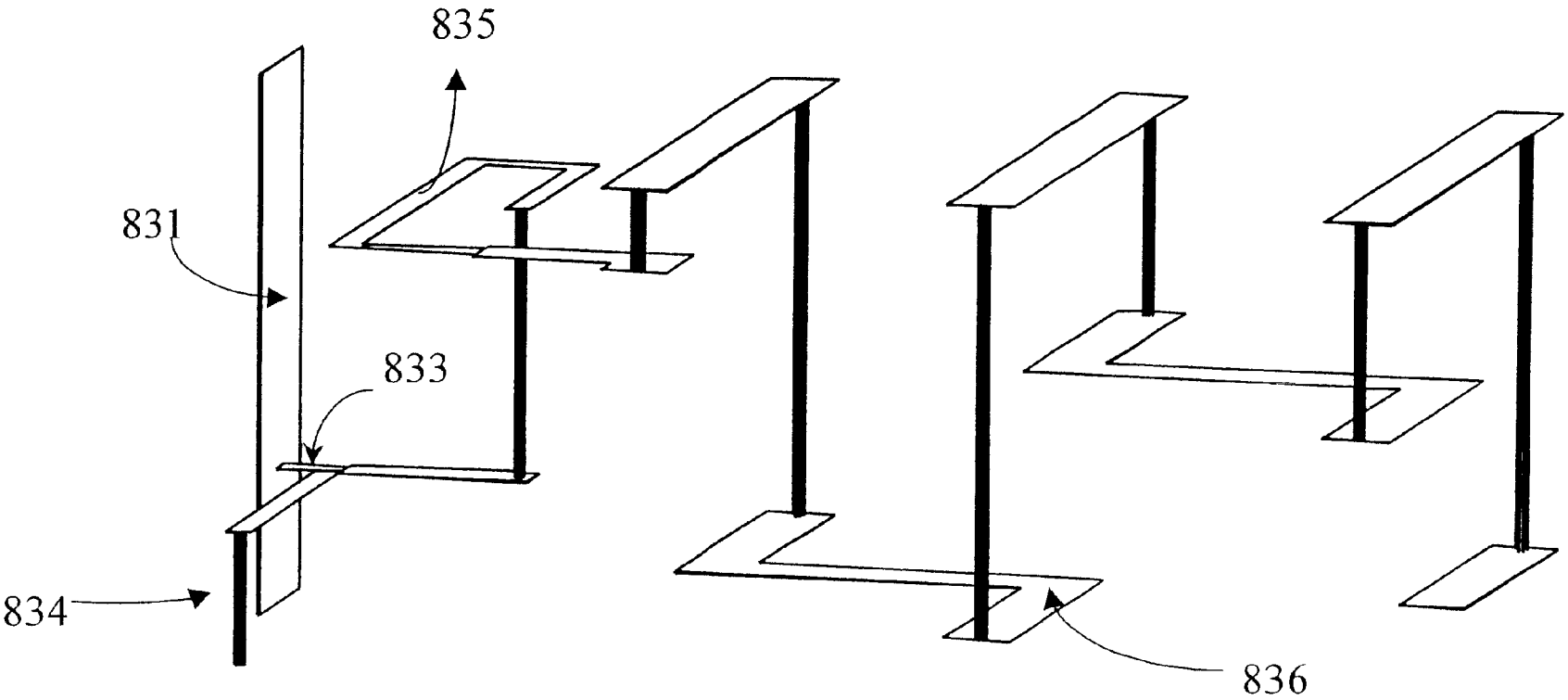
FIG. 11A is a partial front perspective view showing one embodiment for a meandering conductor, feeding conductor, and matching conductor of the present invention.
Figure 11B:
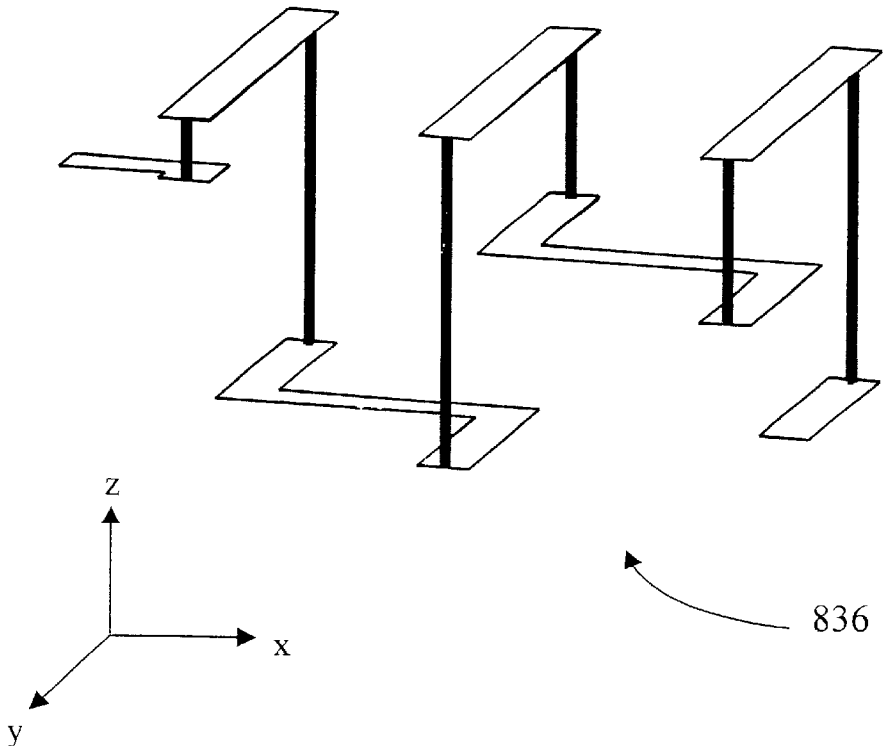
FIG. 11B is an isolated front perspective view of the meandering conductor of FIG. 11A.

FIGS. 11A and 11B show the three-dimensional aspect of the meandering conductor 836. In particular, as shown in FIG. 11A, the first and second matching conductor portions are disposed at different levels relative to the vertically disposed feeding pad 831 in order to achieve the effect of impedance exchange. By parallel connecting first and second matching conductor portions 835 and 834, an input impedance matching circuit is formed and this circuit series connected to the feeding conductor 833 and meandering conductor 836. FIG. 11B shows the manner in which the meandering conductor 836 is extended relative to x, y and z coordinates. By extending in the x, y and z directions and reaching for at least two or more distinct levels or layers of the substrate, various sections of the meandering conductor can be specifically set in the substrate 837 at different depths and in different directions. Moreover, the desired bandwidth can be obtained through input impedance matching by varying the length and width of the second matching conductor portion 834 and/or first matching conductor portion 835.

Figure 12:
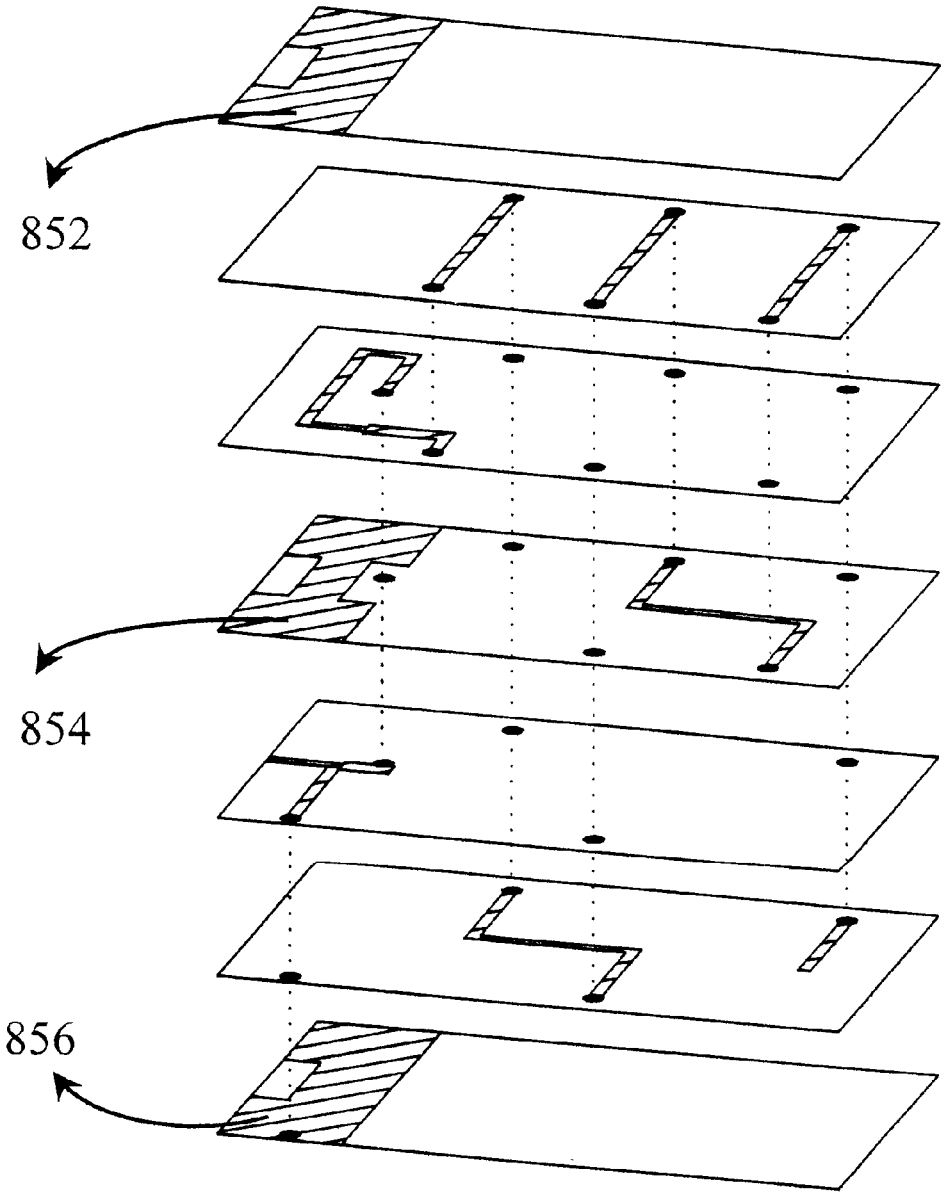
FIG. 12 an exploded view showing layers of the chip antenna of FIG. 8.

In FIG. 12, an exploded view of the substrate is shown to illustrate various locations of, e.g., the top, middle, and bottom plates 852, 854 and 856 with respect to different layers of the substrate.

Figure 13:
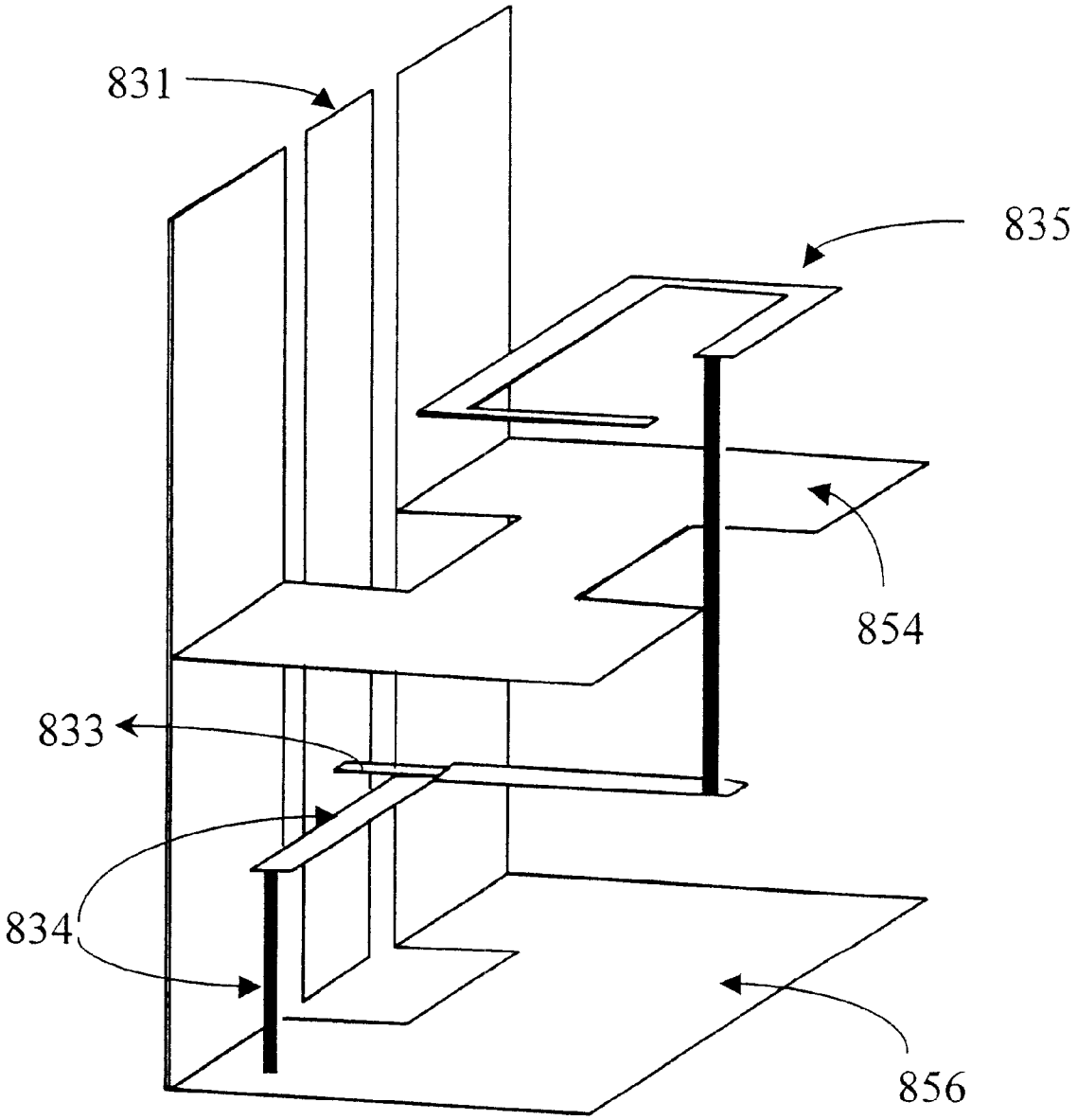
FIG. 13 is an isolated perspective view showing another embodiment for a ground, feeding pad, feeding conductor, and matching conductor of the present invention.

When the first matching conductor portion 835 is not sandwiched between plates, but shielded by only one plate (e.g., the middle plate 854) as shown in FIG. 13, a microstrip line structure is formed. By contrast, the second matching conductor portion 834 as shown in FIG. 13 forms a strip line structure (see above discussion with respect to FIG. 10). Conversely, when the second matching conductor portion 834 is connected to and shielded by only one plate (i.e., the middle plate 854) as shown in FIG. 14, then the microstrip line structure is formed as compared to the first conductor portion 835, which is in the strip line structure since it is shielded by both top plate 852 and the middle plate 854.

Figure 14:
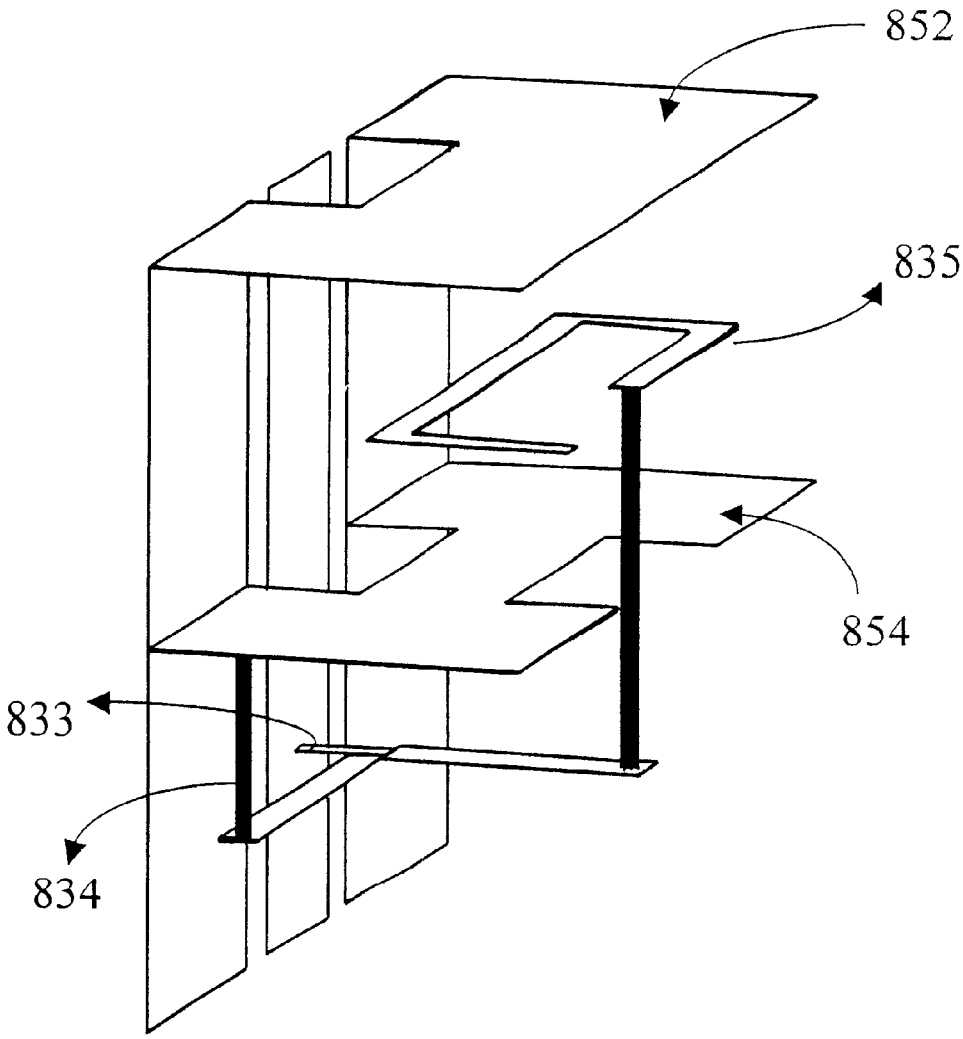
FIG. 14 is yet another embodiment for a ground, feeding pad, feeding conductor, and matching conductor of the present invention.
Figure 15:
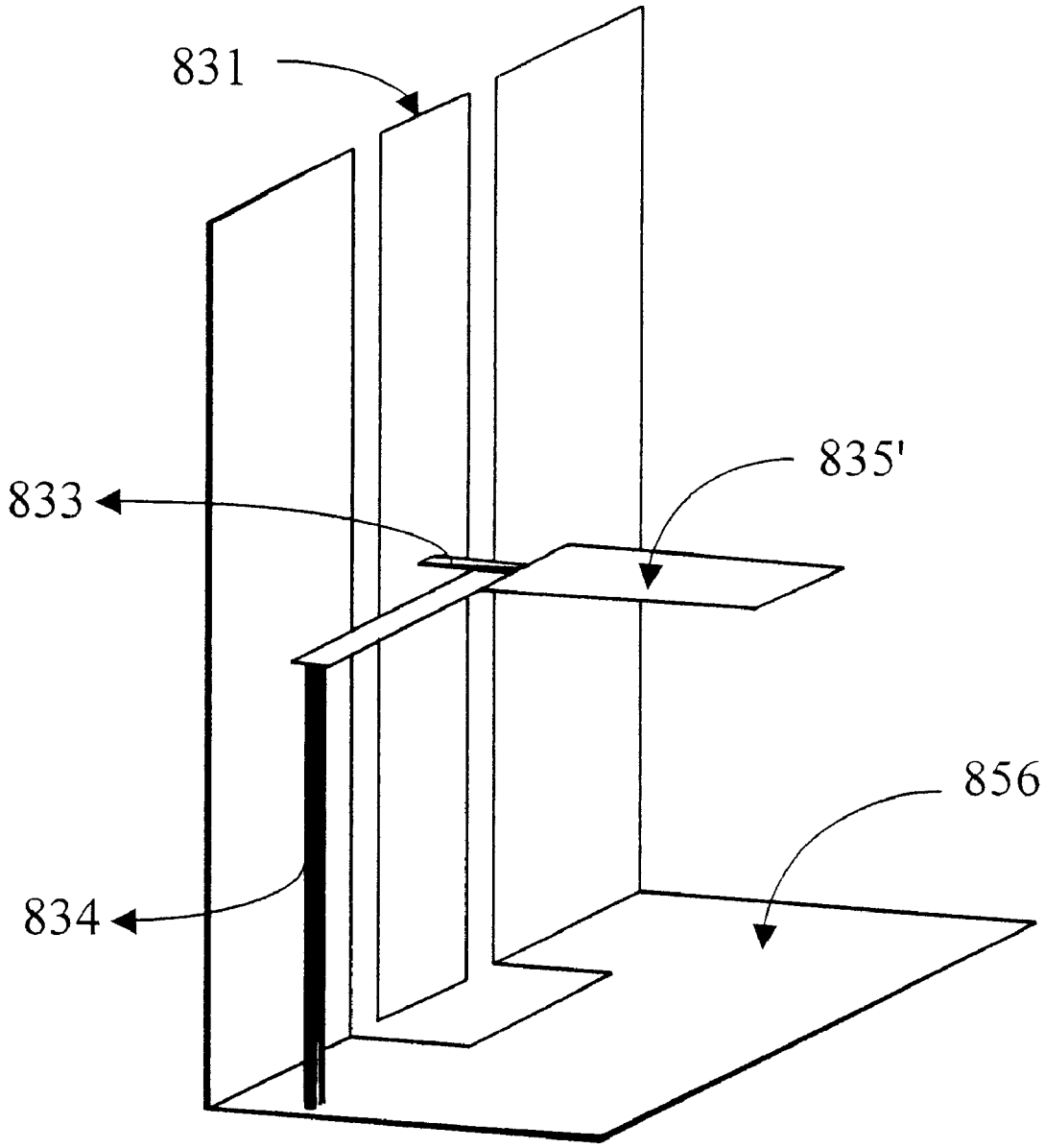
FIG. 15 is still yet another embodiment for a ground, feeding pad, feeding conductor, and matching conductor of the present invention.
Figure 16:
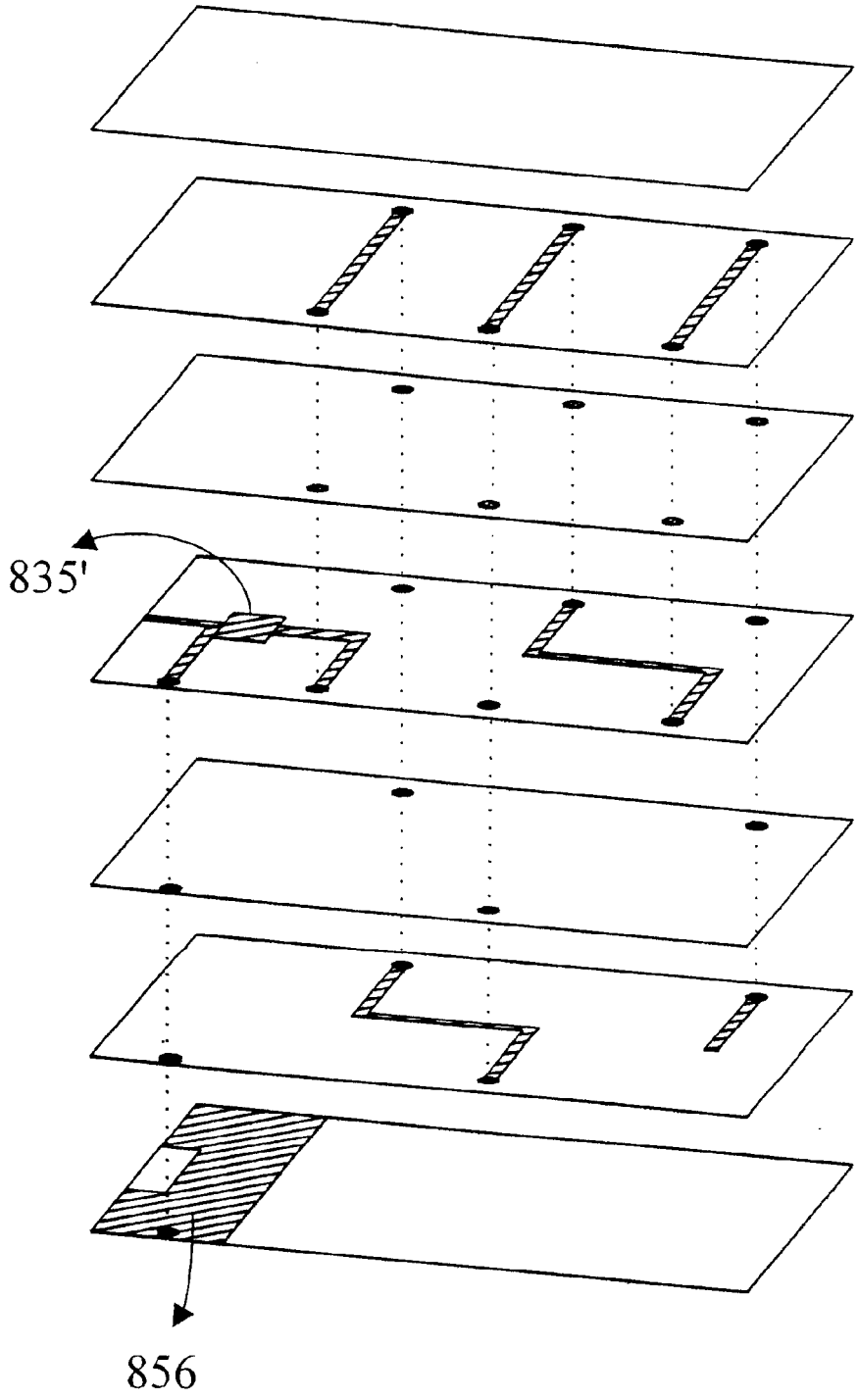
FIG. 16 is another exploded view showing layers of the chip antenna of FIG. 15.

One way to simplify the structures as shown in FIGS. 13 and 14 is to only use a microstrip line structure as shown in FIG. 15 so that the second matching conductor portion 834, which is coupled to a simplified first matching conductor portion 835', is connected to and shielded by the bottom plate 856. The various locations of, e.g., the simplified second matching conductor portion 835' and bottom plate 856 with respect to different levels or layers of the substrate is shown in FIG. 16.

While the present invention as shown and described above has provided examples for explaining in detail the application of the invention, these examples do not limit the scope of the invention. It is understood by those skilled in the art that various changes or modifications of the invention may be made therein without departing from the spirit and scope of the invention.

The terms and expression which have been employed herein are used as terms of description and not of limitation, and there is no intent, in the use of such terms and expressions, of excluding any of the equivalents of the features shown and described or portions thereof but it is recognized that various modifications are possible within the scope of the invention claimed.

What is claimed is:

1. A chip antenna comprising:

a substrate of a dielectric material and one or more layers;

a feeding port formed on an outer surface of the substrate for signal injection;

a feeding conduct or disposed on one of said substrate layers and connected to the feeding pad for signal propagation;

a meandering conductor disposed on at least one of the substrate layers; and a matching unit disposed on said substrate layers and positioned between the feeding conductor and the meandering conductor, said matching unit connected with feeding conductor and the meandering conductor in order to match the input impedance and increase the bandwidth of the chip antenna.

2. The chip antenna according to claim 1, wherein said matching unit comprises:

a ground of at least one plate disposed on the surface of the substrate; and a matching conductor disposed on said substrate layers and shielded by said at least one plate of the ground, wherein portions of said matching conductor are respectively connected to said meandering conductor, said ground, and said feeding conductor.

3. The chip antenna according to claim 2, wherein said matching conductor includes a first matching conductor portion and a second matching conductor portion, said second matching conductor portion being connected with said feeding conductor and said ground, and said first matching conductor portion being connected with said second matching conductor portion, said feeding conductor and said meandering conductor.

4. The chip antenna according to claim 3, wherein said first matching conductor, said first matching conductor portion, and said meandering conductor are disposed on at least two different substrate layers.

5. The chip antenna according to claim 3, wherein said ground of at least one plate, and said first matching conductor is configured to form a strip line structure.

6. The chip antenna according to claim 3, wherein said ground of at least one plate, and portions of said first matching conductor is configured to form a strip line structure.

7. The chip antenna according to claim 3, wherein said ground of at least one plate, and said first matching conductor is configured to form a microstrip line structure.

8. The chip antenna according to claim 3, wherein said ground of at least one plate, and portions of said first matching conductor is configured to form a microstrip line structure.

9. The chip antenna according to claim 3, wherein said ground of at least one plate, and said second matching conductor is configured to form a strip line structure.

10. The chip antenna according to claim 3, wherein said ground of at least one plate, and said second matching conductor is configured to form a microstrip line structure.

11. The chip antenna according to claim 5, wherein said ground of at least one plate, and said second matching conductor is configured to form a strip line structure.

12. The chip antenna according to claim 7, wherein said ground of at least one plate, and said second matching conductor is configured to form a microstrip line structure.

13. The chip antenna according to claim 6, wherein said ground of at least one plate, and said second matching conductor is configured to form a microstrip line structure.

14. The chip antenna according to claim 8, wherein said ground of at least one plate, and said second matching conductor is configured to form a strip line structure.

15. The chip antenna according to claim 1, wherein said meandering conductor is spirally wound on said substrate layers.

16. The chip antenna according to claim 15, wherein said meandering conductor consists of sections, said sections being connected but separately disposed at different layers of said substrate.

17. The chip antenna according to claim 1, wherein said meandering conductor is disposed on one of said substrate layers.

18. The chip antenna according to claim 17, wherein said meandering conductor is a square or z wave in shape.

19. The chip antenna according to claim 1, wherein said dielectric material is consisted of ceramics material.

20. The chip antenna according to claim 3, wherein said feeding conductor, said second matching conductor, and said meandering conductor are disposed on at least one different layers of said substrate layers.

21. The chip antenna according to claim 3, wherein said feeding conductor, said first matching conductor and said meandering conductor are disposed on a same substrate layer.

22. The chip antenna according to claim 3, wherein said feeding conductor and said first matching conductor are both disposed on a same substrate layer.

23. The chip antenna according to claim 22, wherein said meandering conductor is spirally wound on said substrate layers.

* * * * *